US009725283B2

(12) United States Patent
Roivainen et al.

(10) Patent No.: US 9,725,283 B2
(45) Date of Patent: Aug. 8, 2017

(54) ELEVATOR

(71) Applicant: KONE CORPORATION, Helsinki (FI)

(72) Inventors: Gabriela Roivainen, Hyvinkää (FI); Panu Ihalainen, Tervakoski (FI)

(73) Assignee: KONE CORPORATION, Helsinki (FI)

( * ) Notice: Subject to any disclaimer, the term of this patent is extended or adjusted under 35 U.S.C. 154(b) by 0 days.

(21) Appl. No.: 14/817,927

(22) Filed: Aug. 4, 2015

(65) Prior Publication Data

US 2016/0031677 A1 Feb. 4, 2016

Related U.S. Application Data

(63) Continuation of application No. PCT/EP2014/050823, filed on Jan. 16, 2014.

(30) Foreign Application Priority Data

Feb. 4, 2013 (EP) ..... 13153920

(51) Int. Cl.

| | |
|---|---|
| ***B66B 17/12*** | (2006.01) |
| ***B66B 9/00*** | (2006.01) |
| ***B66B 11/00*** | (2006.01) |
| ***B66B 11/02*** | (2006.01) |
| *B66B 11/08* | (2006.01) |

(52) U.S. Cl.
CPC ..... *B66B 9/00* (2013.01); *B66B 11/0226* (2013.01); *B66B 17/12* (2013.01)

(58) Field of Classification Search
CPC .... B66B 17/12; B66B 11/0226; B66B 11/026
USPC ..... 187/404
See application file for complete search history.

(56) References Cited

U.S. PATENT DOCUMENTS 3,945,468 A * 3/1976 Miura ..... B66B 11/0226 187/401
5,080,201 A * 1/1992 Yoo ..... B66B 17/12 187/404
5,220,979 A * 6/1993 Matsuda ..... B66B 11/0226 187/401

(Continued)

FOREIGN PATENT DOCUMENTS

JP 11-079612 A 3/1999
JP 2004196533 A * 7/2004 ..... B66B 17/12

(Continued)

OTHER PUBLICATIONS

AIPN, Machine Translation, JP 2005 053635 A, May 23, 2016, pp. 1-20.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

An elevator includes a car and a counterweight suspended on hoisting ropes which are driven by a drive machine. The counterweight has a first side facing the elevator car path and a second side opposite to the car path. The counterweight includes at least one connecting passage between the first and second side of the counterweight. With this solution, air pressure built between the car and the counterweight when passing in the elevator shaft is reduced and the travel comfort is improved.

14 Claims, 2 Drawing Sheets

(56) References Cited

U.S. PATENT DOCUMENTS

Figure 1:
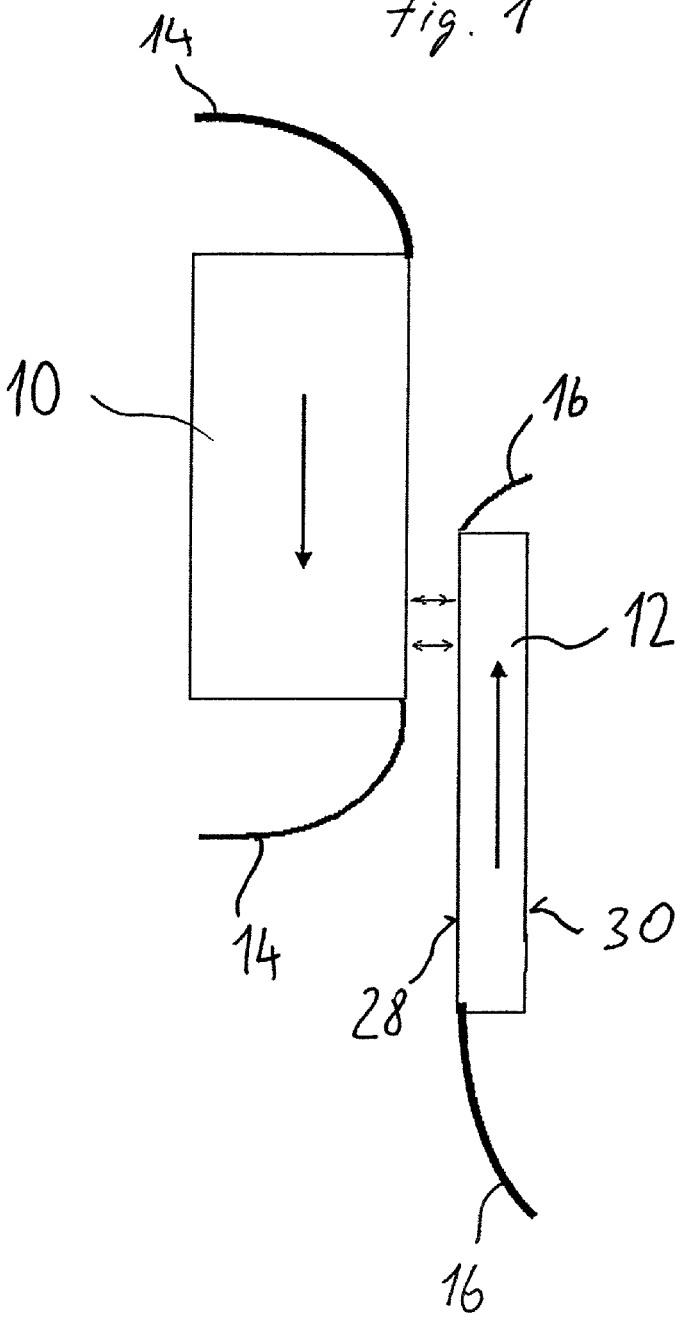

| | | | | | |
|---|---|---|---|---|---|
| 5,251,726 | A * | 10/1993 | de Jong | B66B 13/285 | 187/401 |
| 5,306,208 | A * | 4/1994 | Sommerrock | B66B 11/024 | 454/254 |
| 2006/0289242 | A1* | 12/2006 | Oberer | B66B 13/285 | 187/333 |
| 2007/0289821 | A1 | 12/2007 | Ach | | |
| 2008/0000728 | A1* | 1/2008 | Kuipers | B66B 11/0005 | 187/406 |
| 2010/0116597 | A1* | 5/2010 | Matsuda | B66B 11/028 | 187/401 |
| 2010/0126810 | A1* | 5/2010 | Opoku | B66B 11/024 | 187/401 |

FOREIGN PATENT DOCUMENTS

| | | | | |
|---|---|---|---|---|
| JP | 2005053635 | A * | 3/2005 | B66B 11/0226 |
| JP | 2005-145645 | A | 6/2005 | |

* cited by examiner

ELEVATOR

CROSS REFERENCE TO RELATED APPLICATIONS

This application is a Continuation of PCT International Application No. PCT/EP2014/050823, filed on Jan. 16, 2014, which claims priority under 35 U.S.C. 119(*a*) to Patent Application No. 13153920.7, filed in Europe on Feb. 4, 2013, all of which are hereby expressly incorporated by reference into the present application.

The present invention refers to an elevator comprising a car and a counter-weight suspended on hoisting ropes which are driven by a drive machine. The counterweight has a first side facing the elevator car path and a second side opposite to the car path. This is the standard layout for any elevator where the car and the counterweight are arranged side by side in an elevator shaft. Particularly with high-rise elevators and fast moving elevators with a velocity of more than 3 m/s, the problem of vibrations and turbulence occurs when the car and counterweight meet in the shaft travelling in opposite directions.

To solve this problem, fairings have been mounted to the bottom and top of the elevator car and of the elevator counterweight. These fairings have reduced the problem of the vibrations. Anyway also with the use of fairings, an overpressure is built between the car and the counterweight when they meet on their tracks travelling in opposite directions. This overpressure still produces vibrations turbulences and a load on the guide rails. The JP 2005 145645 A and the US 2007/289821 A1 show an elevator according to the preamble of claim 1.

It is object of the present invention to provide an elevator, particularly a fast moving elevator with a velocity of more than 3 m/s wherein the above mentioned problem is reduced.

This object is solved with an elevator according to claim 1 and with a counter-weight according to claim 11. Preferred embodiments are subject matter of the corresponding dependent claims. Inventive embodiments are also presented in the description part of the present application. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

According to the invention, the counterweight in an elevator of the above-mentioned type comprises connecting passages between the first and second side of the counterweight. These passages serve to lead the air trapped in the gap between the car and counterweight, particularly laterally, away from that gap.

It is clear for the skilled person that for said purpose the passages have to have a certain cross-sectional area to be able to effectively reduce the pressure in the gap between the car and counterweight when they meet with high velocity travelling in opposite directions. Therefore, preferably the passages have a cross-sectional area of at least 5%, better of at least 10% of the area of the counterweight's side facing the car path.

Usually the counterweight of an elevator is built under use of stacks of weight elements arranged one above the other. Preferably, the passages are provided between these stacks of weight elements. On that behalf e.g. spacers may be located between said stacks of weight elements which keep the stacks apart from each other thus forming the passages. This is a comparably easy and costs-saving solution for the provision of the passages. This solution further allows a comparably free distribution of the passages between the stacks of weight elements. Instead of stacks of weight elements also one-piece weight elements may be used.

Preferably, the passages are distributed as evenly as possible over the complete area of the counterweight' side facing the car path. Anyway, the amount of passages should be limited to a certain degree, for example at uppermost 30% of the area of the counterweight's side facing the car path, as to avoid that the length of the counterweight has to be increased unduly because of the provision of the passages.

In a preferred embodiment of the invention, the counterweight comprises two columns of stacks of weight elements which columns are arranged side by side and at least one passage is provided between said columns. This arrangement has the advantage that the passage can be made to extend between said two columns along the length of the counterweight. Thus, the air is led away at a location from the gap between car and counterweight at a location (middle of the counterweight) where the pressure is highest.

Preferably, the counterweight comprises fairings at its top and its bottom as to further reduce turbulences and vibrations occurring because of the high travel velocity of the counterweight.

Preferably, the car comprises fairings at its top and its bottom to reduce the air resistance or aerodynamic drag so as to reduce the vibrations and turbulences occurring during the high-speed travel of the car, particularly when the car and the counterweight meet on their travel in opposite directions.

It is particularly advantageous when the car as well as the counterweight have fairings at their top and their bottom which may co-act so as to reduce the aerodynamic drag and to reduce the air pressure between them when they meet during the operation of the elevator.

Preferably, the counterweight comprises at least five passages distributed over the width and length of the counterweight. Via this advantageous homogeneous distribution of the passages over the counterweight the air caught in the gap between the car and the counterweight can easily be guided away.

In a preferred embodiment of the invention, the passages are labyrinth passages which do not provide a direct (see through) connection from the first to the second side. These labyrinth passages are able to guide the air pressure away from the gap between the car and counterweight and additionally reduce air noise which is caused by the passages when the counterweight is travelling with a high velocity.

In this connection it has to be carried out that the invention is particularly provided for elevators travelling with a high velocity, these are elevators travelling with a velocity of 3 m/s and more, particularly for elevators which are travelling with a velocity of 5 m/s and more.

It shall further be clarified that the above-mentioned preferred embodiments of the invention may be combined with each other as long as there are no technical reasons against such a combination.

The invention also refers to a counterweight comprising connecting passages between the first and second side of the counterweight. Regarding the further details of the passages, reference is made to the above description of the inventive elevator.

The invention is now described by means of an example in connection with a schematic drawing.

Figure 2:
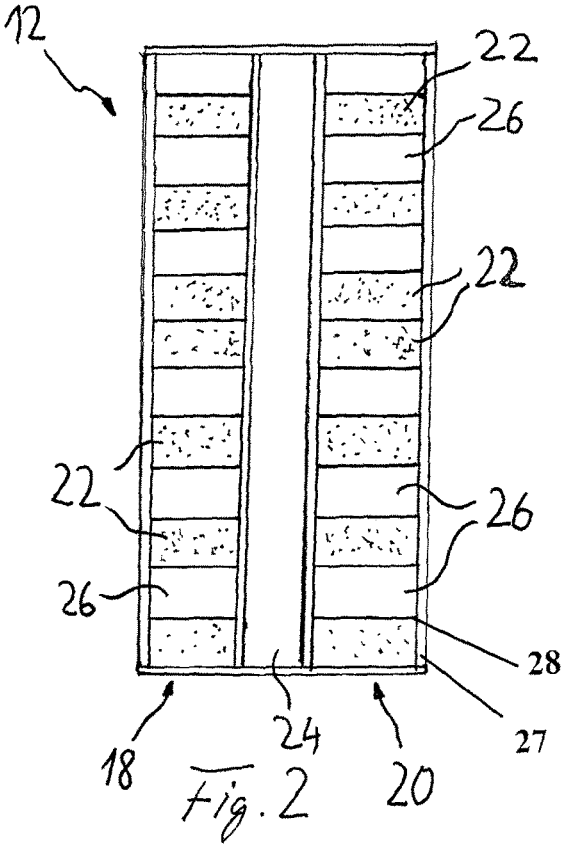
Figure 3:
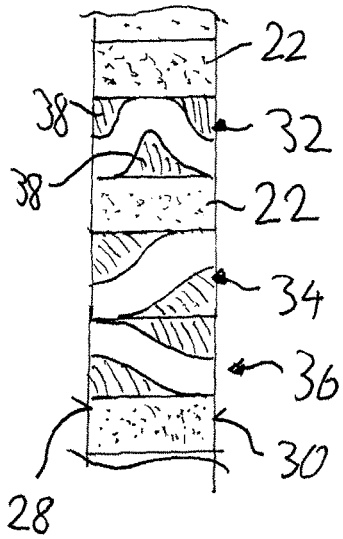

FIG. 1 shows a schematic diagram of a car and counterweight meeting in an elevator shaft, FIG. 2 a side view of the counterweight with a side facing the elevator car path, and FIG. 3 shows an embodiment with three examples of labyrinth passages for the reduction of air noise.

FIG. 1 shows a car 10 and a counterweight 12 of a traction sheave elevator suspended by hoisting ropes. The car and counterweight travel in an elevator shaft (not shown) in opposite directions which are indicated by arrows. The car has upper and lower fairings 14 and the counterweight has upper and lower fairings 16 which serve to reduce the aerodynamic drag. The car and counterweight 10, 12 belong to an elevator travelling with a high travel speed of more than 3 or 5 m/s. When the car and counterweight meet on their paths—as it is shown in the figure—the air is pressurized in the gap between the car and counterweight which is indicated by two small horizontal double arrows. This overpressure in the gap between car and counterweight leads to air noise and vibrations. Further this pressure cushion in the gap between car and counterweight causes load and stress to the guide means and the guide rails guiding the elevator car and the counterweight vertically along the elevator shaft. On that behalf, the counterweight 12 comprises passages for leading away the trapped air from its first side 28 facing the car path to its second side 30 opposite the car path. The passages are shown in FIG. 2.

In FIG. 2 the counterweight is shown from its first side 28 facing the elevator car path. The counterweight 12 is shown here without the fairings 16. The counterweight comprises two columns 18, 20 with stacks 22 of weight elements arranged vertically one above the other. Between the two columns 18, 20, a large longitudinal first passage 24 is provided which serves to guide air from the first side shown in the figure to the opposite second side of the counterweight. Further, second passages 26 are provided between the stacks 22 of weight elements which are also configured to lead air from the area between the car and counterweight to the other side of the counterweight. The counterweight further comprises a frame 27, wherein the frame comprises distance elements 28 keeping the stacks 22 of weight elements spaced apart. Instead of the stacks of weight elements also one piece weight elements 22 may be used. As is may be seen from the figure, the second passages 26 are distributed quite homogeneously over the counterweight area so that the passage of air from the first side 28 of the counterweight to its second side takes 30 place quite homogeneously over the complete counterweight area. In FIG. 2, the first passage 24 as well as the second passages 26 form direct (see-through) through-holes which directly connect the first side to the second side. Via these passages the air can flow laterally away from the gap between car and counterweight without being diverted. This solution offers passages with a low air resistance.

FIG. 3 shows alternative embodiments of passages for a connection between the first side 28 and the second side 30 of the counterweight 12. The figure shows stacks 22 of weight elements (or one-piece weight elements 22) and in between three different types of labyrinth passages 32, 34 and 36. All three embodiments of labyrinth passages 32, 34 and 36 are passages where the first side 28 is not directly (see-through) connected with the second side 30 but so that there are air guides 38 in between. This leads to the fact that one cannot look from the first side to the second side. When air is flowing from the first side to the second side, it is deviated and has to flow around these air guides 38 which leads to a reduction of air noise caused by the passages 32, 34, 36.

These labyrinth passages may also have other geometries than those shown in the examples of the labyrinth passages 32, 34 and 36.

The labyrinth passages can partly or totally replace the second passages 26 shown in FIG. 2.

It shall be clear for the skilled person that the above-mentioned embodiments may be combined with each other arbitrarily as long as this is technically feasible.

The invention can be varied within the scope of the appended patent claims.

The invention claimed is:

1. An elevator comprising:

a car; and a counterweight suspended on hoisting ropes driven by a drive machine, wherein the counterweight comprises:

a first side facing an elevator car path and a second side opposite to the first side, at least one connecting passage between the first and second side of the counterweight, and stacks of weight elements arranged one above the other, wherein the at least one connecting passage is a labyrinth passage, wherein the at least one connecting passage is configured to lead air from the first side of the counterweight to the second side of the counterweight, and wherein the at least one connecting passage is provided between the stacks of said weight elements.

2. The elevator according to claim 1, wherein the at least one connecting passage has a cross-sectional area of at least 10% of a cross-sectional area of the first side of the counterweight.

3. The elevator according to claim 2, wherein the counterweight comprises two columns of weight elements arranged side by side and a channel is provided between said columns.

4. The elevator according to claim 2, wherein the counterweight comprises a counterweight top surface and a counterweight bottom surface, wherein a first fairing is provided at the counterweight top surface, and wherein a second fairing is provided at the counterweight bottom surface.

5. The elevator according to claim 1, wherein the counterweight comprises two columns of stacks of weight elements arranged side by side and a channel is provided between said columns.

6. The elevator according to claim 1, wherein the counterweight comprises a counterweight top surface and a counterweight bottom surface, wherein a first fairing is provided at the counterweight top surface, and wherein a second fairing is provided at the counterweight bottom surface.

7. The elevator according to claim 1, wherein the car comprises a car top and a car bottom surface, wherein a third faring is provided at the car top surface, and wherein a fourth faring is provided at the car bottom surface.

8. The elevator according to claim 1, wherein the counterweight further comprises a channel extending in a direction transverse to the at least one connecting passage.

9. The elevator according to claim 1, wherein the counterweight comprises several stacks of weight elements provided in at least one frame of the counterweight and the connecting passages are formed by distance elements keeping the stacks of weight elements spaced apart.

10. The elevator according to claim 1, wherein the at least one connecting passage includes at least one air guide configured to deflect air flow between the first and second sides of the counterweight.

11. The elevator according to claim 1, wherein the at least one connecting passage has a cross-sectional area of at least 5% of a cross-sectional area of the first side of the counterweight.

12. A counterweight comprising:

a first side configured to face an elevator car path;

a second side configured to be arranged opposite to the first side;

at least one connecting passage between the first and second side of the counterweight, and stacks of weight elements arranged one above the other, wherein the at least one connecting passage is a labyrinth passage, wherein the at least one connecting passage is configured to lead air from the first side of the counterweight to the second side of the counterweight, and wherein the at least one connecting passage is provided between the stacks of said weight elements.

13. The counterweight according to claim 12, wherein the counterweight comprises two columns of weight elements arranged side by side and a channel is provided between said columns.

14. The elevator according to claim 12, wherein the counterweight comprises a counterweight top surface and a counterweight bottom surface, wherein a first fairing is provided at the counterweight top surface, and wherein a second fairing is provided at the counterweight bottom surface.

* * * * *